United States Patent [19]

Schwarz et al.

[11] 4,389,873

[45] Jun. 28, 1983

[54] TUBE BENDER CONSTRUCTION

[75] Inventors: Albert J. Schwarz, Lincolnwood; Leonard J. Kowal, Prospect Heights, both of Ill.

[73] Assignee: Imperial Clevite Inc., Rolling Meadows, Ill.

[21] Appl. No.: 242,598

[22] Filed: Mar. 11, 1981

[51] Int. Cl.[3] ..... B21D 7/02

[52] U.S. Cl. ..... 72/388; 72/217

[58] Field of Search ..... 72/388, 459, 458, 457, 72/217, 32, 34, 36

[56] References Cited

U.S. PATENT DOCUMENTS

| | | | |
|---|---|---|---|
| 1,761,798 | 6/1930 | Potter | 72/459 |
| 2,796,785 | 6/1957 | Philippe | 72/459 |
| 2,887,917 | 5/1959 | Kowal | 72/459 |
| 3,750,447 | 8/1973 | Kowal | 72/388 |
| 3,926,028 | 12/1975 | Kowal | 72/388 |
| 4,132,100 | 1/1979 | Schuler | 72/388 |

FOREIGN PATENT DOCUMENTS

| | | | |
|---|---|---|---|
| 1201662 | 9/1965 | Fed. Rep. of Germany | 72/459 |
| 2904885 | 8/1980 | Fed. Rep. of Germany | 72/459 |

*Primary Examiner*—Gene Crosby

*Attorney, Agent, or Firm*—Wood, Dalton, Phillips, Mason & Rowe

[57] ABSTRACT

A tube bender construction wherein the forming member is swingably mounted to the form wheel to be adjustable toward and from the form wheel groove to accommodate variations in tube diameter and normal wear of portions of the tube bender during the life thereof. The form wheel defines a concave force transfer surface having an improved engagement with the tube to be bent so as to effectively improve maintained tube roundness for effectively minimized stress formation in the bent tube.

23 Claims, 8 Drawing Figures

Fig. 4.
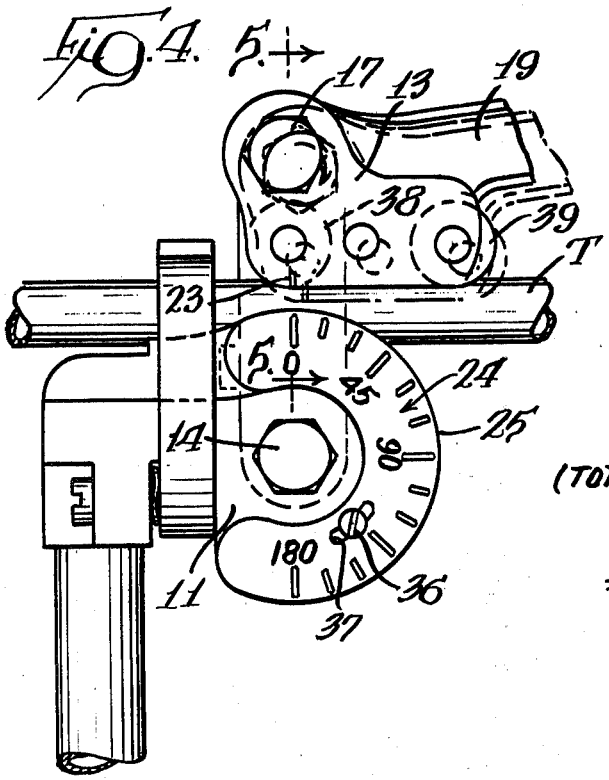
Fig. 5.
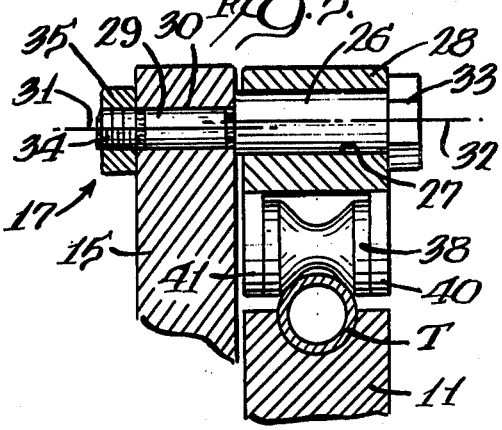
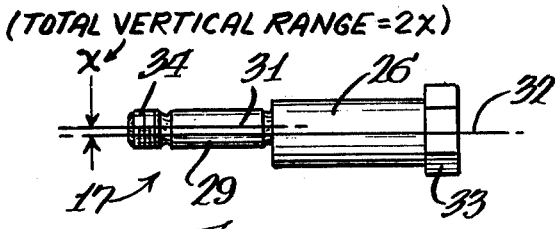
Fig. 6.
Fig. 7.
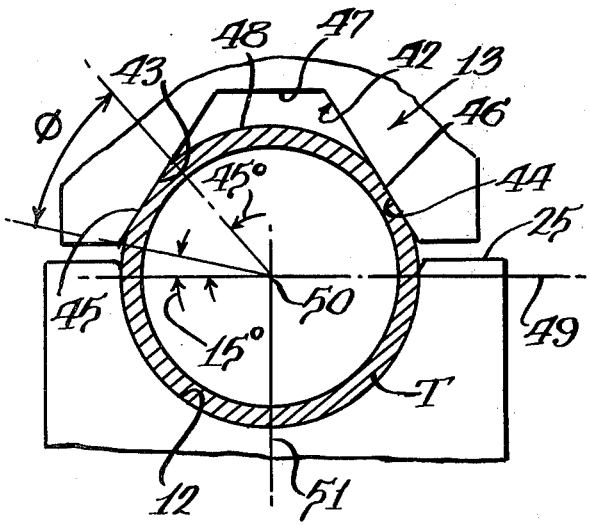
Fig. 8.
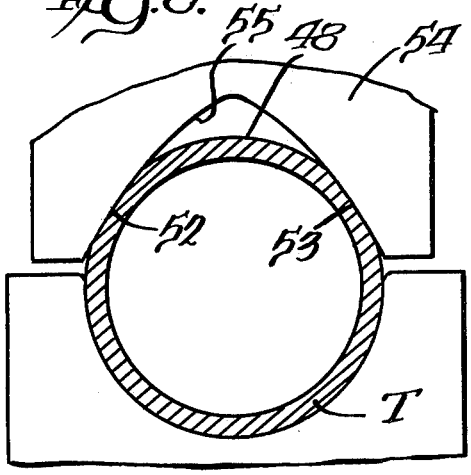

TUBE BENDER CONSTRUCTION

BACKGROUND OF THE INVENTION

1. Field of the Invention

This invention relates to tube benders and in particular to manually operable tube benders wherein a forming member is swung about a form wheel so as to forcibly urge a tube into a peripheral arcuate groove of the form wheel to effect a desired bend therein.

2. Description of the Background Art

Manually operable tube benders having a forming member mounted to swing about a bend axis of a forming wheel are well known in the art. Illustratively, in U.S. Pat. No. 2,796,785 of Howard L. Philippe, a manually operable tube bender is shown to have a forming member swingably mounted to the form wheel by means of a link. The forming member comprises a shoe having a groove engaging the outer surface of the tube to be bent and defining the force transfer surface between the shoe and tube. The shoe is pivotally connected to the link by a pivot having a fixed radial distance from the pivot of the link to the form wheel. The form wheel groove has a U-shaped configuration and the groove of the shoe has an arcuate extent of less than 180° for limiting undesirable flattening deformation of the tube in the bending operation.

Leonard J. Kowal, in U.S. Pat. No. 2,887,917, shows a tube bender having a bending shoe swingably mounted to the mandrel with the mandrel having an improved scale means thereon for use in indicating the extent of the bend produced.

In U.S. Pat. No. 3,926,028 of Leonard J. Kowal, another form of manually operable tube bender is illustrated.

In U.S. Pat. No. 3,750,447 of Leonard J. Kowal et al, still another form of manually operable tube bender having a shoe member swingably mounted to the mandrel is disclosed in combination with a novel tube-retaining hook structure.

SUMMARY OF THE INVENTION

The present invention comprehends an improved tube bender construction having means for adjustably mounting the forming member to the form wheel so as to permit maintained accurate disposition of the forming member relative to the bending groove of the form wheel, notwithstanding wear on the components of the tube bender and permitting desired force transfer engagement between the forming member and the tube to be bent, notwithstanding variations in the diameter of the tube to be bent.

Thus, the present invention provides a novel means for accommodating a range of different tube sizes, permitting the use of metric and conventional English dimension tubing with similar efficacy in effecting the bending. Thus, the invention eliminates the need for the provision of different configuration forming member elements in utilization of the tube bender alternatively with such different dimensional tubing.

The invention comprehends the provision of means for adjusting the dispositiion of the forming member relative to the bending groove of the form wheel by means of adjustable means interconnecting the forming member to the member swingably mounting the forming member to the form wheel.

In the illustrated embodiment, the adjusting means comprises eccentric means for facilitated adjustment of the forming member toward and from the peripheral edge of the forming wheel defining the bending groove.

The invention further comprehends the provision of positioning means for positioning the connecting element mounting the forming member to the form wheel in a bend-start position for correspondingly positioning the forming member in the bend-start position during the adjustment of the positioning thereof relative to the form wheel.

The form wheel may be provided with an adjustable scale for use illustratively where the adjustment of the positioning of the forming member is other than radially toward the tube bend axis about which the forming member swings.

The invention further comprehends the provision of an improved force transfer surface configuration of the forming member so as to effectively minimize stress concentration and deformation of the tubing being bent.

More specifically, the invention comprehends the provision of a concave force transfer surface on the forming member arranged to engage the portion of the tube extending outwardly from the bend groove of the form wheel at transversely opposite portions thereof spaced adjacent the peripheral edge of the form wheel and having a limited outward extent.

In the illustrated embodiment, the portion of the tube engaged by the force transfer surface of the forming member is angularly spaced from a plane through the cross-sectional center of the tube perpendicular to a radius through the center of the bend axis at least approximately 15°.

In the illustrated embodiment, the extent of the surface of the tube engaged by the forming member away from the plane through the cross-sectional center of the tube perpendicular to a radius through the center of the bend axis is no greater than approximately 45°.

The invention comprehends that the force transfer surface of the forming member be selectively rectilinear in transverse cross section, or rounded as desired.

The invention comprehends that the bight portion of the concave tube-engaging surface be arranged to have clearance with the radially outermost portion of the tube between the side portions engaged by the side surface portions of the tube-engaging surface.

In one form, the bight portion is trapezoidal in transverse cross section, and in another illustrated form, the bight portion is rounded.

The invention comprehends the provision of the novel force transfer surface of the forming member both in the form of the forming member wherein the force transfer surface is defined by one or more rollers, as well as in the shoe form of such forming member wherein the force transfer surface is defined by a groove formed in a shoe element, such as disclosed in the above discussed background art U.S. patents.

Where the force transfer surface is defined by a roller, a second roller may be provided spaced from the first roller for engaging the tube at a point radially outwardly of the peripheral edge of the form wheel.

The tube-engaging surface of the second roller may be defined by a surface having the force transfer surface portions and clearance bight portion as discussed above, as well as a surface of any conventional configuration. The provision of the means for adjusting the disposition of the forming member relative to the peripheral edge of the form wheel permits the maintenance of the force transfer surface engagement with the tube in the desired angularity range, as discussed above, notwithstanding wear of the tube bender components and the provision of different diameter tubing to be bent, as discussed above.

The tube bender construction of the present invention is extremely simple and economical, while yet providing the highly desirable features discussed above.

BRIEF DESCRIPTION OF THE DRAWING

Other features and advantages of the invention will be apparent from the following description taken in connection with the accompanying drawing wherein:

FIG. 4 is a fragmentary side elevation thereof illustrating, in broken lines, an adjusted position of the forming member;

FIG. 5 is a fragmentary transverse section taken substantially along the line 5—5 of FIG. 4;

FIG. 6 is an elevation of the eccentric forming member adjusting means pin;

FIG. 7 is a transverse section illustrating in greater detail the improved force transfer surface configuration of the forming member; and FIG. 8 is a transverse section illustrating another form of force transfer surface configuration embodying the invention.

DESCRIPTION OF THE PREFERRED EMBODIMENT

Figure 1:
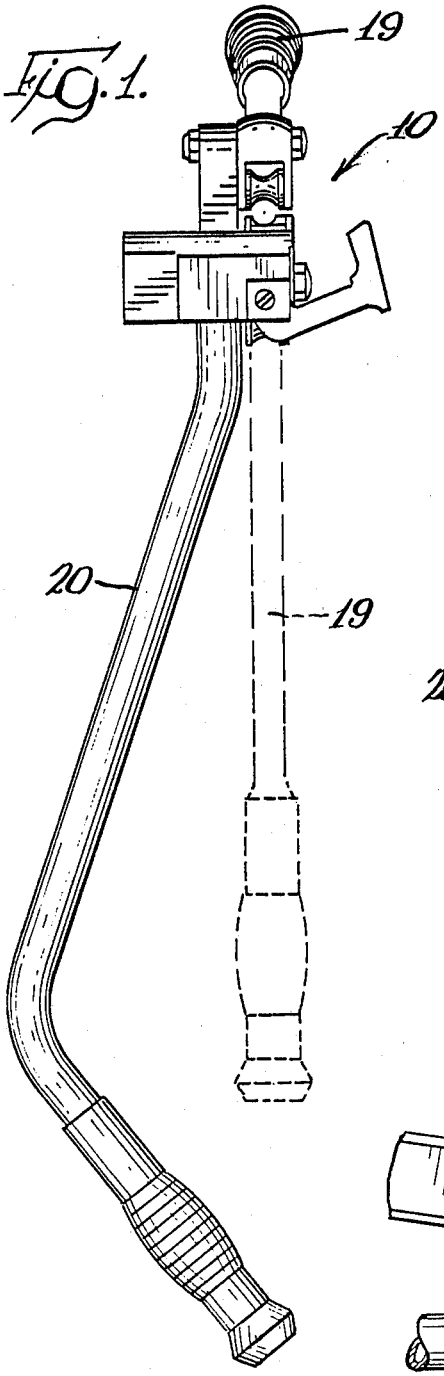
FIG. 1 is an elevation of a tube bender embodying the invention.

In the exemplary embodiment of the invention as disclosed in the drawing, a manually operable tube bender generally designated 10 is shown to include a form wheel 11 defining an annular peripheral bending groove 12. A tube to be bent T is bent into the forming groove by a forming member 13. The forming member is swung about a bending axis 14 of the groove 12 by means of a swing link 15 having one end pivotally connected to the forming member by a pivot 16 and the opposite end connected to the forming member 13 by a pivot connection 17.

Tube T is held against longitudinal displacement during the bending operation by a hook 18.

Figure 2:
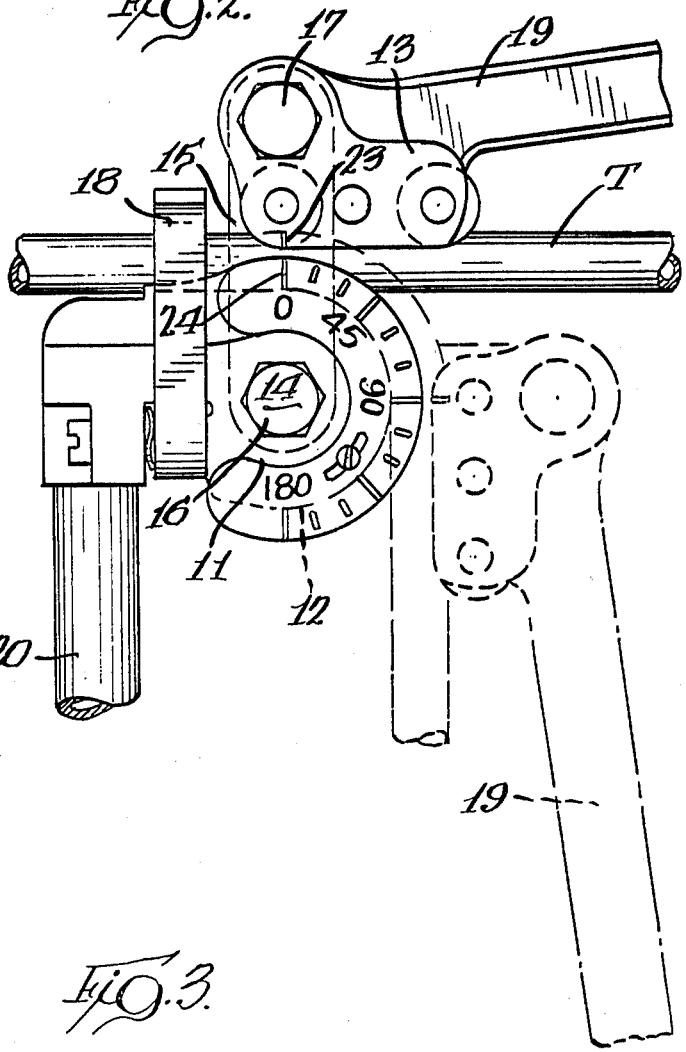
FIG. 2 is a fragmentary side elevation thereof with the forming member shown in a 90° bend position in broken lines.
Figure 3:
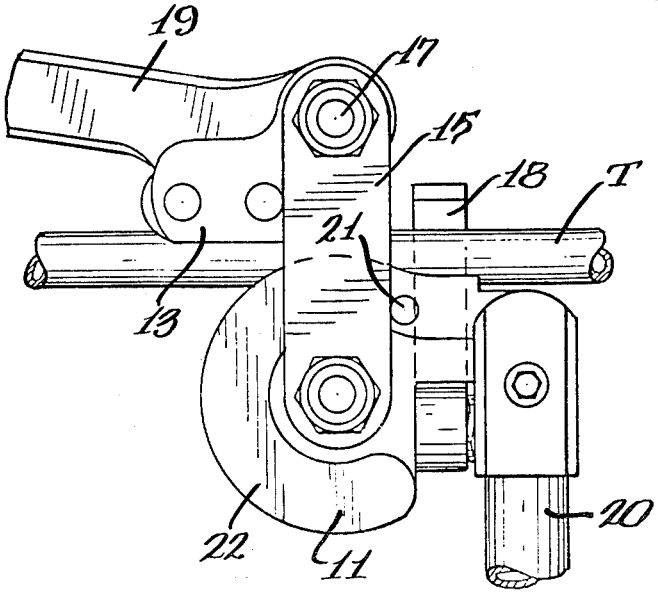
FIG. 3 is a fragmentary rear elevation thereof.

Movement of the forming member 13 relative to form wheel 1 is effected by manipulation of a handle 19 connected to the forming member 13, and a second handle 20 connected to the form wheel 11. As shown in FIG. 3, when handle 19 is swung to bring the forming member 13 to a bend start position, link 15 is positioned by its engagement with a stop shoulder element 21 provided on the rear face 22 of the form wheel 11. As further illustrated in FIG. 2, forming member 13 may be provided with an indicium 23 juxtaposed to a scale 24 carried by the form wheel 11 for indicating the disposition of forming member 13 in the bend start position illustrated in FIG. 2 and for indicating the angular extent of the bend formed in the tube, such as illustrated in dotted lines in FIG. 2 as a 90° bend.

As indicated briefly above, a problem arises in such swingable forming member tube benders in that, as a result of wear of the components of the tube bender, a loose fit may result between the forming member and the tube held in the bending groove. It is necessary to have proper force transfer engagement of the forming member with the tube in order to prevent undistorted bends and to meet standards of ovality of the bent tube such as required by the Nuclear Code, etc. One solution to this problem employed in heavy duty bench-type tube benders is to provide a screwed clamping arrangement which forces a contoured follower shoe against the tubing prior to the bending. The contoured shoe is a separate loose piece which is placed in position and requires that the clamping adjustment must be made and released each time a bend is made with the tool. High frictional forces are generated as a result of the requirement of high clamping force. In such structure, the follow bar is a loose member which is free to move longitudinally of the tube bend so that the tube will remain undamaged. The necessary high forces would require, in a manually operable tube bender, extremely long operating handles to provide the necessary moment arms.

The present invention eliminates the need for such adjustable contoured shoe structures by providing means for adjusting the position of the forming member 13 toward and from the peripheral edge 25 of the form wheel 11 so as to cause the forming member to have desired accurate force transfer engagement with the tube T. In the illustrated embodiment, the adjustment of the forming member is effected by the provision of an adjustable pivot 17 defined by a pivot pin having a first mounting portion 26 pivotally mounted in a bore 27 of the forming member body 28, as illustrated in FIG. 5. A second cylindrical portion 29 of the pivot pin 17 is pivotally received in a bore 30 of link 15. Axi 31 of cylindrical portion 29 is offset from the axis 32 of cylindrical portion 26 and, thus, the pivot pin 17 defines an eccentric pin. As further shown in FIG. 5, one end of the pin is provided with a head 33 adapted to be engaged by a suitable tool, such as a wrench, and the opposite end of the pin is threaded as at 34 for threaded engagement with a suitable nut 35.

Adjustment of the forming member 13 toward and from the form wheel edge 25 is effected by the turning of head 33 so as to displace axis 32 of cylindrical portion 26 toward or from the form wheel edge 25 as it swings about the axis 31 of cylindrical portion 29. During such adjustment, nut 35 may be loosened on threaded end 34 and upon completion of the adjustment, the retightening of the nut 35 secures the pivot means in the adjusted disposition.

As will be obvious to those skilled in the art, the eccentric adjusting means is exemplary, the invention comprehending that any suitable means for adjusting the position of the forming member 13 radially of the bend axis 14 may be utilized within the scope of the invention.

As shown in FIG. 4, the scale 24 may comprise an adjustable scale adjustably mounted to the form wheel 11 by a suitable screw 36 extended through an arcuate slot 37 in the scale 24. Thus, the scale 24 may be adjusted to line up with the indicium 23 identifying the bend start point in each of the adjusted positions of the forming member.

In the illustrated embodiment, the adjusting means is infinitely adjustable, it being obvious to those skilled in the art that discrete adjusting means are equally comprehended within the broad scope of the invention.

In the illustrated embodiment, the forming member is provided with a pair of rollers 38 and 39 which are rotatably mounted between a pair of side plates 40 and 41 depending in spaced relationship from the forming member body portion 28. Roller 38 is axially aligned with the bend start indicium 23 and roller 39 is spaced outwardly therefrom so as to engage a portion of the tube T longitudinally outwardly from the portion engaged by roller 38, and, as seen in FIG. 4, at a position spaced radially outwardly of the edge 25 of the form wheel 1. Thus, as handle 19 is swung in a clockwise direction, as seen in FIG. 4, the forming member rollers 38 and 39 cooperate in bending the tube into the form wheel groove 12, as seen in FIG. 2, with the leading roller 39 firstly deflecting the outwardly extending portion of the tube T toward the form wheel edge 25 and the roller 38 urging the tube firmly into the groove, completing the bending thereof.

As indicated above, the invention further comprehends an improved arrangement of the force transfer surface on the forming member 13 for transferring the bending force from the forming member to the tube T. As best seen in FIG. 7, the forming member defines a concave tube-engaging surface generally designated 42 for engaging the tube and effecting the force transfer thereto. The tube-engaging surface further defines side surface portions 43 and 44 engaging side portions 45 and 46 of the tube outwardly adjacent the form wheel edge 25 and groove 12 therein. The concave surface 42 further defines a bight portion 47 between the surface portions 43 and 44 arranged to have clearance with the radially outermost portion 48 of the tube between the side portions 45 and 46.

The invention comprehends that the engagement between the forming member force transfer surface portions 43 and 44 and the tube be over a limited angular extent illustrated in FIG. 7 as angle $\phi$. As shown in FIG. 7, the side portions of the tube 45 and 46 engaged by the side surfaces of the forming member are angularly spaced at least approximately 15 degrees from a plane 49 drawn through the cross-sectional center 50 of the tube perpendicular to a radius 51 extending through said tube center 50 from the bend axis 14. The side portions of the tube engaged by the forming member extend outwardly to a position no greater than approximately 45 degrees from plane 49 and, thus, the angle $\phi$ extends approximately 30 degrees in the illustrated embodiment.

As illustrated in FIG. 7, the side surfaces 43 and 44 of the forming member may be rectilinear in transverse cross section so as to have effectively minimum surface contact with the engaged surfaces of the tube 45 and 46. Alternatively, however, the surfaces of the forming member may be rounded, such as surfaces 52 and 53 of the forming member 54 illustrated in FIG. 8. Thus, in the embodiment of FIG. 7, the bight portion 47 is substantially trapezoidal in transverse cross section, whereas the bight portion 55 of the forming member 54 is rounded, such as in an arch configuration, in transverse section, as illustrated in FIG. 8. The specific configuration of the bight portion of the concave surface does not appear to be critical in the invention as long as clearance is provided relative to the outermost portion 48 of the tube to be bent with the force transfer engagement of the forming member side surface portions being with portions of the tube outwardly of the form wheel groove of limited angular extent.

As a result of the force transfer from the novel arrangement of force transfer surface portions of the forming member hereof, the tube bending forces are applied at a region of the tube where a relatively thick wall is maintained as compared to the stretched outermost portion 48 thereof.

No direct flattening force is applied to the outermost portion 48 of the tube, and the bending forces transmitted from the bending surfaces 43, 44, 52 and 53 define transversely inwardly directed components resisting lateral spreading of the tube, thereby further effectively minimizing flattening or increased ovality of the tube as a result of the bending operation.

The invention comprehends that at least the roller disposed adjacent the bend start position, such as roller 38 in the embodiment of FIG. 4, be provided with the improved concave force transfer configuration discussed above. The outboard roller, such as roller 39 in the embodiment of FIG. 4, may utilize the novel surface configuration, although it has been found that satisfactory bending of the tube may be effected with the outboard roller utilizing a conventional tube-engaging surface configuration. As will be obvious to those skilled in the art, where the forming member comprises a shoe wherein the force transfer surface is defined by a longitudinal groove in the shoe, the entire groove transverse cross section may utilize the above discussed improved force transfer configuration. It is preferred that at least the portion of the groove adjacent the bend start point have such configuration.

As indicated above, the adjustability of the forming member toward and from the bending groove permitted by the adjustable mounting means cooperates with the improved force transfer surface configuration in providing an improved tube bend with minimum stress and ovality. Thus, the tube bender structure of the present invention provides improved means for complying with the relatively strict nuclear power plant requirements for bent tubes, as set out in Section III of the ASME Code, while yet the tube bender structure is extremely simple and economical of construction.

The foregoing disclosure of specific embodiments is illustrative of the broad inventive concepts comprehended by the invention.

We claim:

1. In a tube bender havng a form wheel defining a tube-receiving bending groove extending arcuately about a bend axis, and means for holding the tube to be bent against longitudinal movement in the bending groove during a tube bending operation, the improvement comprising:

a forming member defining a concave tube-engaging surface; and adjustable mounting means for operatively mounting the forming member to the form wheel to swing about said bend axis outwardly adjacent said bending groove including means for adjustably moving the forming member radially of said bend axis toward said bend start point into engagement with a tube to be bent in the bending groove thereat to have desired bending force transfer engagement with each tube to be bent seriatim thereby notwithstanding differences in the diameters of the different tubes.

2. The tube bender of claim 1 wherein said adjustable mounting means includes a swing member pivotally mounted to the form wheel and said adjustable mounting means adjustably mounting the forming member to the swing member.

3. The tube bender of claim 1 wherein said adjustable mounting means includes a swing member pivotally mounted to the form wheel and eccentric means for adjustably mounting the forming member to the swing member.

4. The tube bender of claim 1 wherein said forming member includes roller means defining said tube-engaging surface thereof.

5. The tube bender of claim 1 wherein said tube-engaging surface comprises a plurality of spaced portions engaging the tube at longitudinally spaced positions.

6. The tube bender of claim 1 wherein said form wheel is provided with an angle scale adjustably mounted thereto.

7. The tube bender of claim 1 wherein said adjustable mounting means comprises infinitely adjustable means.

8. The tube bender construction of claim 1 wherein said forming member defines a concave tube-engaging surface for engaging a tube received therein in effecting the force transfer thereto, said tube-engaging surface defining side surface portions for engaging side portions of the tube outwardly adjacent the form wheel groove and a bight portion arranged to have clearance with the radially outermost portion of the tube between said side portions of the tube.

9. The tube bender construction of claim 8 wherein said side portions of the tube engaging surfaces are angularly spaced at least approximately 15° from a plane through the cross-sectional center of the tube perpendicular to a radius through said center from said bend axis.

10. The tube bender construction of claim 8 wherein said side portions of the tube engaging surfaces extend outwardly to a position no greater than aproximately 45° to a plane through the cross-sectional center of the tube perpendicular to a radius through said center from said bend axis.

11. The tube bender construction of claim 8 wherein said side portions of the tube engaging surfaces are angularly spaced at least approximately 15° from a plane through the cross-sectional center of the tube perpendicular to a radius through said center from said bend axis and extend outwardly to a position no greater than approximately 45° to said plane.

12. The tube bender construction of claim 8 wherein said side surface portions of the forming member are rectilinear in transverse section.

13. The tube bender construction of claim 8 wherein said side surface portions of the forming member are rounded in transverse section.

14. The tube bender construction of claim 8 wherein said bight portion is trapezoidal in transverse cross section.

15. The tube bender construction of claim 8 wherein said bight portion is rounded in transverse cross section.

16. The tube bender construction of claim 8 wherein said forming member includes roller means defining said tube-engaging surface thereof.

17. The tube bender construction of claim 8 wherein said forming member includes a roller adjacent said mounting means defining at least a portion of said tube-engaging surface.

18. The tube bender construction of claim 8 wherein said forming member includes a roller adjacent said mounting means defining at least a portion of said tube-engaging surface, and a second roller spaced from said roller for engaging the tube remotely from said wheel.

19. The tube bender construction of claim 8 wherein said forming member includes a roller adjacent said mounting means defining at least a portion of said tube-engaging surface, and a second roller spaced from said roller for engaging the tube remotely from said wheel, said second roller also defining a portion of said tube-engaging surface.

20. The tube bender of claim 8 wherein said adjustable mounting means includes a swing member pivotally mounted to the form wheel and said adjustable mounting means adjustably mounting the forming member to the swing member.

21. The tube bender of claim 8 wherein said form wheel is provided with an angle scale adjustably mounted thereto.

22. In a tube bender having a form wheel defining a tube-receiving bending groove extending arcuately about a bend axis, and means for holding the tube to be bent against longitudinal movement in the bending groove during a tube bending operation, the improvement comprising:

a forming member defining a concave tube-engaging surface; and adjustable mounting means for operatively mounting the forming member to the form wheel to swing about said bend axis outwardly adjacent said bending groove at any one of a plurality of different distances radially from said bending axis to have desired bending force transfer engagement with the tube to be bent outwardly of the bending groove, said adjustable mounting means including a swing member pivotally mounted to the form wheel, means for adjustably mounting the forming member to the swing member, and shoulder means for positioning the swing member in a preselected bend start position for permitting adjustment of the radial positioning of the forming member with the forming member disposed in the bend start position thereof.

23. The tube bender of claim 22 wherein said shoulder means is disposed on said form wheel.

* * * * *